US005253660A

United States Patent [19]

Dixit et al.

[11] Patent Number: 5,253,660

[45] Date of Patent: Oct. 19, 1993

[54] REDUCED SIDESTREAM SMOKE SMOKING ARTICLE WRAPPERS, METHODS OF MAKING SUCH WRAPPERS AND SMOKING ARTICLES MADE FROM SUCH WRAPPERS

[75] Inventors: Ajit S. Dixit; William F. Owens, Jr., both of Pisgah Forest, N.C.

[73] Assignee: P. H. Glatfelter Company, Spring Grove, Pa.

[21] Appl. No.: 873,230

[22] Filed: Apr. 24, 1992

[51] Int. Cl.[5] ..... A24D 1/02

[52] U.S. Cl. ..... 131/365; 162/139

[58] Field of Search ..... 131/365; 162/139, 141, 162/158, 181.4, 8

[56] References Cited

U.S. PATENT DOCUMENTS

| | | | |
|---|---|---|---|
| 2,673,799 | 3/1954 | Schur | 131/365 X |
| 3,744,496 | 7/1973 | McCarty et al. | 131/8 |
| 4,231,377 | 11/1980 | Cline et al. | 131/9 |
| 4,450,847 | 5/1984 | Owens | 131/365 |
| 4,461,311 | 7/1984 | Mathews et al. | 131/365 |
| 4,805,644 | 2/1989 | Hampl, Jr. et al. | 131/365 |
| 4,881,557 | 11/1989 | Martin | 131/365 |
| 4,915,118 | 4/1990 | Kaufman et al. | 131/365 |
| 4,921,916 | 5/1990 | Howell et al. | 525/423 |
| 4,999,387 | 3/1991 | Rothon et al. | 523/205 |
| 5,057,367 | 10/1991 | Morii et al. | 428/389 |

*Primary Examiner*—V. Millin
*Assistant Examiner*—J. Doyle
*Attorney, Agent, or Firm*—Kerkam, Stowell, Kondracki & Clarke

[57] ABSTRACT

A cigarette or cigar wrapper is disclosed wherein the paper filler consists of two homogeneously intermixed minerals, viz huntite and hydromagnesite, alone, or admixed with calcium carbonate or magnesium hydroxide or calcium carbonate and magnesium hydroxide and carbon.

15 Claims, No Drawings

REDUCED SIDESTREAM SMOKE SMOKING ARTICLE WRAPPERS, METHODS OF MAKING SUCH WRAPPERS AND SMOKING ARTICLES MADE FROM SUCH WRAPPERS

SUMMARY OF THE INVENTION

This invention relates to smoking articles, such as cigarettes, cigars and the like, and the wrapper for the tobacco column thereof, that provide acceptable burn rates, produce light-colored, well-formed ash which clings tightly without premature flaking, have significantly reduced sidestream smoke generation compared to conventional cigarettes and deliver both mainstream and sidestream smoke with acceptable taste and aroma. These desirable properties are achieved when certain defined levels of ULTRACARB (a mineral additive and a paper filler consisting of two homogeneously intermixed minerals, viz huntite and hydromagnesite).

The ULTRACARB may be used as the only filler, or in combination with calcium carbonate co-filler, in combination with magnesium hydroxide and calcium carbonate co-fillers, or in combination with magnesium hydroxide, calcium carbonate and carbon co-fillers, to produce a base cigarette paper or cigar wrapper. The paper may be subjected to treatment with burning chemicals, such as alkali metal salts of carboxylic acids. ULTRACARB wrappers can be employed as a normal cigarette paper or as an inner liner. Organic or inorganic acid treatment of such papers can be utilized to improve the subjective taste properties of the resulting cigarettes. Such papers can also be used in combination with filter dilution and perforation of the base paper to optimize taste and mainstream smoke yields.

BACKGROUND OF THE INVENTION

The reduced sidestream smoke cigarette paper patents which describe magnesium oxide/magnesium hydroxide as paper fillers, and which define burning chemical types and levels, are U.S. Pat. Nos. 4,231,377; 4,450,847; 4,881,557; and 4,915,118. These patents claim alkali metal acetates, citrates, nitrates, carbonates ad tartrates as burning chemical types at levels in the sheet ranging from 0.5% to 8.0%.

Other patents which relate to reduced sidestream smoke cigarette papers are U.S. Pat. Nos. 4,461,311 and 4,805,644. These patents disclose sodium and potassium salts of succinic, carbonic, formic, acetic, propionic, malic, lactic, glycolic, citric, tartaric, fumaric, oxalic, malonic, nitric, and phosphoric acids at levels in the sheet up to 25% weight. U.S. Pat. No. 4,805,644, dealing with reduced sidestream smoke cigarette paper, discloses that various paper fillers with superficial surface areas of at least $20M^2/g$ result in a wrapper that provides reduced sidestream smoke when incorporated in paper at 5% to 50% by weight.

U.S. Pat. No. 3,744,496 discloses a carbon-filled paper wrapper for cigarettes and/or cigars, preferable used as an inner liner with regular cigarette paper or cigar wrapper as an outer wrap.

DETAILED DESCRIPTION OF THE INVENTION

It has been experimentally determined that cigarette paper with ULTRACARB as a filler in the furnish of the paper, by itself, or in combination with a calcium carbonate co-filler, or in combination with calcium carbonate and magnesium hydroxide co-fillers, or in combination with calcium carbonate, magnesium hydroxide and activated carbon co-fillers, provides an enhancement in sidestream smoke reduction compared to that of a conventional calcium carbonate-filled cigarette paper while maintaining acceptable ash quality, static burn rate, mainstream and sidestream taste and aroma. The truly novel feature of this invention is the reduced sidestream smoke obtained with this unique filler. ULTRACARB is a novel mineral based on a unique deposit of two homogeneously intermixed minerals, viz huntite $Mg_3Ca(CO_3)_4$ and hydromagnesite $Mg_4(CO_3)_3(OH)_2.3H_2O$. On exposure to heat, the minerals in ULTRACARB decompose presumably as follows:

$$Mg_3Ca(CO_3)_4 3\ MgO + CaO + 4CO_2$$

$$Mg_4(CO_3)_3(OH)_2.3H_2O\ 4MgO + 3CO_2 + 4H_2O$$

These reactions are strongly endothermic with a heat change $\Delta H = 1000$ J/g and generate non-combustible, non-toxic, non-corrosive gases. ULTRACARB mineral filler is marketed in the U.S. by Anzon Incorporated, 2545 Aramingo Avenue, Philadelphia, Pa. 19125, and is supplied worldwide by Microfine Minerals Limited, Raynesway, Derby, Great Britain.

PARAMETERS OF THE INVENTION

| | % of the Basis Weight of Paper |
|---|---|
| Basis Weight of Paper: | 20 to 100 $g/M^2$ (preferred 35 to 65 $g/M_2$) |
| ULTRACARB Content: | 5% to 50% (preferred 10% to 35%) |
| Calcium Carbonate Content: | 0% to 40% (preferred 10% to 30%) |
| Activated Carbon Content: | 0% to 25% (preferred 0% to 15%) |
| Magnesium Hydroxide Content: | 0% to 25% (preferred 5% to 15%) |
| Acid Addition: | 0% to 10% (preferred 0% to 3%) |
| Porosity Base Sheet: | 3 to 50 (cm/min) CORESTA preferred 5 to 15 (cm/min) CORESTA |
| ULTRACARB Types | Untreated and surface modified (stearate, olefinic treated), ULTRACARB U5, ULTRACARB C5, ULTRACARB C5-25 ULTRACARB P5-20 and L5 |
| Burning Chemical: | Alkali metal salts of carboxylic acids selected from a group consisting of citric, malic, lactic, glycolic, tartaric, fumaric, maleic, malonic, glutaric, adipic, acetic and succinic, in combination with or without sucrose and organic carboxylic acids named above. |
| Burning Chemical Addition Rate: | 0.5% to 6% |
| Smoking Articles: | Cigarettes, Cigars, and the like |

TYPICAL PROPERTIES OF ULTRACARB TYPES U5, L5, C5, C5-25 AND P5-20

| | U5 | |
|---|---|---|
| Typical Chemical Analysis: | | |
| Magnesium | as MgO | 38% |
| Calcium | as CaO | 8% |
| Silicon | as $SiO_2$ | 0.3% |
| Aluminum | as $Al_2O_3$ | 0.06% |
| Potassium | as $K_2O$ | 0.01% |
| Iron | as $Fe_2O_3$ | 0.02% |
| Sulphur | as $SO_3$ | 0.02% |
| Titanium | as $TiO_2$ | 0.02% |
| Loss on Ignition | (44% $CO_2$ + 9% $H_2O$) | 53% |
| Acid insoluble matter | | 0.2% |
| Water soluble salts | | 0.1% |
| Typical Physical Properties: | | |

-continued

| | | |
|---|---|---|
| Specific Gravity | | 2.5 |
| Oil Absorption | g/100 g | 40 |
| Refractive index | mean | 1.56 |
| Specific Surface area (nitrogen absorption) | $m^2/g$ | 15 |
| Mean spherical diameter (nitrogen absorption) | Micron | 0.16 |
| Color: Tristimulus Values (MgO = 100) | X | 95 |
| | Y | 95 |
| | Z | 94 |
| Bulk Density - loose | Kg/liter | 0.23 |
| pH | (10% aqueous suspension) | 9 |
| Particle shape | | platey |
| Typical Particle Size Distribution | | |
| Percentage finer as measured by Micromeritics "Sedigraph" | 10 micron | 99.9 |
| | 5 micron | 95 |
| | 2 micron | 80 |
| | 1 micron | 70 |
| | 0.5 micron | 65 |
| | 0.2 micron | 55 |

L5

| | | |
|---|---|---|
| Typical Chemical Analysis | | |
| Magnesium | as MgO | 38% |
| Calcium | as CaO | 8 |
| Silicon | as $SiO_2$ | 0.3% |
| Aluminum | as $Al_2O_3$ | 0.06% |
| Potassium | as $K_2O$ | 0.01% |
| Iron | as $Fe_2O_3$ | 0.02% |
| Sulphur | as $SO_3$ | 0.02% |
| Titanium | as $TiO_2$ | 0.02% |
| Loss on ignition | (44% CO + 9% $H_2O$) | 53 |
| Acid insoluble matter | | 0.2% |
| Water soluble salts | | 0.1% |
| Typical Physical Properties | | |
| Specific Gravity | | 2.5 |
| Oil Absorption | g/100 g | 40 |
| Refractive Index | mean | 1.56 |
| Specific Surface Area (nitrogen absorption) | $m^2/g$ | 15 |
| Mean Spherical Diameter (nitrogen absorption) | Micron | 0.16 |
| Color: Tristimulus Values | X | 95 |
| | Y | 95 |
| | Z | 94 |
| Bulk Density - loose | kg/liter | 0.23 |
| pH | (10% aqueous suspension) | 9 |
| Particle shape | | platey |
| Thermogravimetric Analysis | | |

| Approx. Decomposition Temperature (degree C.) | Weight Loss % | Cumulative Weight Loss % |
|---|---|---|
| 100 (moisture) | 0.5 | 0.5 |
| 300 | 5.5 | 6 |
| 400 | 14 | 20 |
| 500 | 11 | 31 |
| 600 | 16 | 47 |
| 700 | 6 | 53 |

Thermal decomposition onset temperature 230° C.

P5

ULTRACARB P5 is a carboxylate-coated, partially hydrated magnesium calcium carbonate.

Technical data for the uncoated product ULTRACARB U5 also applies for the surface-treated P5 version. The only significant differences are lower oil absorption (30 g oil per 100 g), slightly higher loss on ignition and a slightly lower pH.

ULTRACARB P5 offers the same benefits over the standard, uncoated U5 grade that are offered by the stearate-coated C5 range. ULTRACARB P5 is preferred over C5 grades where higher loading levels are desired.

The standard product, having a 2% surface coating is ULTRACARB P5-20. Coating levels can be varied, e.g., ULTRACARB P5-10 has a 1.0% coating.

C5

ULTRACARB C5 is a stearate-coated, hydrated magnesium calcium carbonate.

Technical data for the uncoated product ULTRACARB U5 also applies for the surface-treated C5 version. The only significant differences are lower oil absorption (30 g oil per 100 g), slightly higher loss on ignition and a slightly lower pH.

The standard product having a 1% stearate coating is ULTRACARB C5-10. Stearate coating levels can be varied, as desired; e.g., ULTRACARB C5-25 has a 2.5% coating.

TABLE 1

| Cigarette Paper | Basis Weight ($g/M^2$) | $CaCO_3$ (%)[3] | $Mg(OH)_2$ (%)[2] | ULTRACARB (%) | Carbon (%) | Porosity Coresta | Fillers | Static Burn Rate (mg/min) | SSDR[1] (mg/min) |
|---|---|---|---|---|---|---|---|---|---|
| Control - Ecusta 12556 | 22.5 | 30.0 | 0.0 | 0.0 | 0.0 | 25.0 | $CaCO_3$ | 56.7 | 2.13 |
| Heavyweight + 1% Citrate | 45.0 | 20.0 | 0.0 | 0.0 | 0.0 | 9.0 | $CaCO_3$ | 50.7 | 1.46 |
| RSS[3] | 45.0 | 15.0 | 0.0 | 25.0 | 0.0 | 6.0 | ULTRACARB U5 $CaCO_3$ | 51.6 | 0.95 |
| RSS[3] | 45.0 | 15.0 | 0.0 | 25.0 | 0.0 | 6.0 | ULTRACARB C5-10, $CaCO_3$ | 49.5 | 0.90 |
| RSS[3] | 45.0 | 15.0 | 10.0 | 15.0 | 0.0 | 7.0 | ULTRACARB U5 $CaCO_3$, $Mg(OH)_2$ | 51.3 | 0.85 |
| RSS[2] | 45.0 | 10.0 | 10.0 | 20.0 | 0.0 | 6.0 | ULTRACARB U5 $Mg(OH)_2$, $CaCO_3$ | 49.7 | 0.87 |
| RSS[2] | 45.0 | 5.0 | 10.0 | 25.0 | 0.0 | 6.0 | ULTRACARB U5 $CaCO_3$, $Mg(OH)_2$ | 45.9 | 0.84 |
| RSS[2] | 45.0 | 0.0 | 10.0 | 30.0 | 0.0 | 7.0 | ULTRACARB U5 $Mg(OH)_2$ | 47.6 | 0.98 |
| RSS[2] | 45.0 | 0.0 | 0.0 | 40.0 | 0.0 | 6.0 | ULTRACARB U5 | 52.3 | 0.99 |
| RSS[2] | 45.0 | 0.0 | 10.0 | 30.0 | 0.0 | 6.0 | ULTRACARB U5 $Mg(OH)_2$ | 35.2 | 0.63 |
| RSS[2] | 45.0 | 0.0 | 0.0 | 40.0 | 0.0 | 7.0 | ULTRACARB U5 | 49.5 | 0.93 |
| RSS[4] | 45.0 | 15.0 | 25.0 | 0.0 | 0.0 | 10.0 | $Mg(OH)_2$, $CaCO_3$ | 75.3 | 0.93 |
| RSS[4] | 45.0 | 25.0 | 15.0 | 0.0 | 0.0 | 10.0 | $Mg(OH)_2$, $CaCO_3$ | 74.9 | 1.09 |
| RSS[3] | 45.0 | 20.0 | 10.0 | 0.0 | 10.0 | 5.0 | $Mg(OH)_2$, Carbon $CaCO_3$ | 49.5 | 0.77 |
| RSS[3] | 45.0 | 5.0 | 10.0 | 15.0 | 10.0 | 4.0 | $Mg(OH)_2$, ULTRACARB U5, $CaCO_3$ carbon | 44.9 | 0.65 |
| RSS[3] | 45.0 | 0.0 | 10.0 | 20.0 | 10.0 | 4.0 | $Mg(OH)_2$, ULTRACARB | 44.3 | 0.65 |

TABLE 1-continued

| Cigarette Paper | Basis Weight ($g/M^2$) | $CaCO_3$ (%)[3] | $Mg(OH)_2$ (%)[2] | ULTRACARB (%) | Carbon (%) | Porosity Coresta | Fillers | Static Burn Rate (mg/min) | SSDR[1] (mg/min) |
|---|---|---|---|---|---|---|---|---|---|
| | | | | | | | U5, carbon | | |

[1]SSDR = Sidestream Delivery Rate (mg/min)
[2]Burning Chemical Content - 8% potassium citrate
[3]Burning Chemical Content - 6.5% potassium + 3% citric acid + 6% sucrose
[4]Burning Chemical Content - 4.8% potassium acetate
COMMENTS ON TABLE 1
It can be concluded from Table 1 that ULTRACARB fillers are effective in significantly reducing the sidestream smoke delivery rate either as a paper filler by itself, in combination with calcium carbonate and magnesium hydroxide co-fillers, or in combination with calcium carbonate, magnesium hydroxide and carbon co-fillers. Burn rate control depends upon burning chemical type and level, sheet porosity, filler type and level and sheet density.

TABLE 2

Ash Properties
Test Cigarettes - Commercial "LIGHTS 100's" with standard paper removed and replaced with the experimental reduced sidestream smoke cigarette paper.

| Cigarette Paper | Static Ash | Puffed Ash |
|---|---|---|
| Control[1] | Tight shrinkage | Tight shrinkage |
| | Light Grey | Light Grey |
| | No flake fall off | No flake fall off |
| | Solid sheath | Small adhering flakes |
| 45 $g/M^2$[2] | Tight shrinkage | Tight shrinkage |
| ULTRACARB - 40% | Light Grey | Light Grey |
| | Few loose flakes | No flake fall off |
| | Small flakes | Small flakes |
| 45 $g/M^2$[3] | Tight shrinkage | Tight shrinkage |
| ULTRACARB - 25% | Light Grey | Light Grey |
| Calcium Carbonate - | No flake fall off | No flake fall off |
| 15% | Solid sheath | Solid sheath |

[1]Ecusta 12556 cigarette paper: 30% calcium carbonate; 25 CORESTA porosity; 25 $g/m^2$; 0.55 citrate burning chemicals.
[2]40% ULTRACARB U5 filler: 6 CORESTA porosity; 45 $g/M^2$; 6.5% potassium citrate + 3% citric acid + 6% sucrose burning chemical.
[3]25% ULTRACARB U5 filler: 15% calcium carbonate filler; 6 CORESTA porosity; 45 $g/M^2$; 8% potassium citrate burning chemical.
Comments on Table 2
The data in Table 2 indicate that both ULTRACARB by itself and the ULTRACARB/calcium carbonate combination result in ash properties very similar to that obtained with regular cigarette paper (control).

TABLE 3

Particle Size and Surface Area Characteristics of ULTRACARB Filler

| Filler | Vendor | Chemical Composition | Particle Size[(1)] Sedigraph (μm) | Specific[(2)] Surface Area ($M^2/g$) |
|---|---|---|---|---|
| ULTRA-CARB U5 | Anzon | Huntite Hydromagnesite | 0.16 | 15 |
| ULTRA-CARB C5 | Anzon | Huntite Hydromagnesite | 0.16 | 15 |

[(1)]Particle Size measured by Micromeritics Sedigraph instrument.
[(2)]Surface Area measured by B.E.T. Nitrogen Adsorption method.
Comments on Table 3
It should be noted that specific surface area for ULTRACARB is only 15 $M^2/g$ which is less than the minimum 20 $M^2/g$ filler surface area claimed by Hampl, et al, (U.S. Pat. No. 4,805,644), as being required for effective sidestream smoke reduction. The outstanding sidestream smoke reduction demonstrated by cigarettes wrapped in papers containing ULTRACARB fillers contradicts the Hampl, et al, claim that sidestream smoke reduction increases with increasing filler surface area.

We claim:

1. A wrapper for smoking articles comprising a cellulosic sheet and an ultracarb, a homogeneous mixture of huntite and hydromagnesite, filler concentration in the sheet in the range of 5% to 50% of the basis weight of the cellulosic sheet.

2. The wrapper, as defined in claim 1, further including calcium carbonate as a co-filler at levels up to 40% of the basis weight of the sheet.

3. The wrapper, as defined in claim 1, further including magnesium hydroxide as a co-filler at levels up to 25% of the basis weight of the sheet.

4. The wrapper, as defined in claim 1, further including calcium carbonate at levels from 10% to 30% of the basis weight of the sheet and activated carbon at levels up to 25% of the basis weight of the sheet as co-fillers.

5. The wrapper, as defined in claim 1, further including activated carbon as a co-filler at levels up to 25% of the basis weight of the sheet.

6. A smoking article comprising a tobacco charge and a wrapper for the tobacco charge, said wrapper comprising a cellulosic sheet and an ultracarb, a homogeneous mixture of huntite and hydromagnesite, filler concentration int he sheet in the range of 5% to 50% of the basis weight of the cellulosic sheet. sheet in the range of 5% to 50% of the basis weight of the cellulosic sheet.

7. A smoking article, as defined in claim 6, further including calcium carbonate as a co-filler at levels up to 40% of the basis weight of the sheet.

8. A smoking article, as defined in claim 6, further including magnesium hydroxide as a co-filler at levels up to 25% of the basis weight of the sheet.

9. A smoking article, as defined in claim 6, further including calcium carbonate at levels from 10% to 30% of the basis weight of the sheet and activated carbon at levels up to 25% of the basis weight of the sheet as co-fillers.

10. The wrapper, as defined in claim 6, further including activated carbon as a co-filler at levels up to 25% of the basis weight of the sheet.

11. A method of reducing sidestream smoke of smoking articles wrapped in a cellulosic sheet comprising forming the sheet with an ultracarb, a homogeneous mixture of huntite and hydromagnesite, filler at levels int he range of 5% to 50% of the basis weight of the cellulosic sheet.

12. The method, as defined in claim 11, further including adding to the sheet calcium carbonate as a co-filler at levels up to 40% of the basis weight of the sheet.

13. The method, as defined in claim 11, further including adding to the sheet magnesium hydroxide at levels up to 25% of the basis weight of the sheet.

14. The method, as defined in claim 11, further including adding calcium carbonate at levels from 10% to 30% of the basis weight of the sheet and activated carbon at levels up to 25% of the basis weight o the sheet as co-fillers.

15. The method, as defined in claim 11, further including adding activated carbon as a co-filler at levels up to 25% of the basis weight of the sheet.

* * * * *